US006499475B2

(12) United States Patent
Vieser et al.

(10) Patent No.: US 6,499,475 B2
(45) Date of Patent: Dec. 31, 2002

(54) METHOD FOR OPERATING AN INTERNAL COMBUSTION ENGINE

(75) Inventors: Steffen Vieser, Schoenaich (DE); Georg Mallebrein, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/924,581

(22) Filed: Aug. 9, 2001

(65) Prior Publication Data

US 2002/0023632 A1 Feb. 28, 2002

(30) Foreign Application Priority Data

Aug. 10, 2000 (DE) ..... 100 38 974

(51) Int. Cl.[7] ..... F02D 41/00
(52) U.S. Cl. ..... 123/692; 123/690; 701/109
(58) Field of Search ..... 123/692, 690, 123/691, 434, 319, 299; 701/109

(56) References Cited

U.S. PATENT DOCUMENTS 5,267,548 A * 12/1993 Rosenzopf et al. ..... 123/692
5,535,135 A * 7/1996 Bush et al. ..... 123/672
5,570,574 A * 11/1996 Yamashita et al. ..... 123/692
6,202,415 B1 * 3/2001 Lohmann et al. ..... 123/691

* cited by examiner

*Primary Examiner*—Bibhu Mohanty
(74) *Attorney, Agent, or Firm*—Walter Ottesen

(57) ABSTRACT

An internal combustion engine (10) has a plurality of cylinders which are arranged in two cylinder banks. A sensor (131, 132) is assigned to each of the two cylinder banks for determining the composition of the exhaust gas. A control apparatus is provided with which a control factor (fr1, fr2) can be determined for each of the two cylinder banks in dependence upon the output signals generated by the two sensors (131, 132). The fuel mass (ti1, ti2), which is to be injected into the two cylinder banks, can be influenced by the control factors. The two control factors (fr1, fr2) of the two cylinder banks can be compared to each other via the control apparatus. The control apparatus can distinguish between a cylinder-bank independent fault and a cylinder-bank dependent fault in dependence upon the two control factors (fr1, fr2).

12 Claims, 1 Drawing Sheet

METHOD FOR OPERATING AN INTERNAL COMBUSTION ENGINE

FIELD OF THE INVENTION

The invention relates to a method for operating an internal combustion engine and especially an internal combustion engine of a motor vehicle.

BACKGROUND OF THE INVENTION

The invention proceeds from a method for operating an internal combustion engine, especially of a motor vehicle, wherein a plurality of cylinders is arranged in two cylinder banks and wherein each of the two cylinder banks is assigned a sensor for determining the composition of the exhaust gas and wherein a control factor for each of the two cylinder banks is determined in dependence upon the output signals generated by the two sensors. The fuel mass, which is injected into the two cylinder banks, is influenced with the control factor. The invention likewise relates to a corresponding internal combustion engine as well as a corresponding control apparatus for an internal combustion engine of this kind.

The cylinders are often arranged in two cylinder banks in multi-cylinder internal combustion engines.

The air, which is necessary for the combustion, is supplied to all cylinders via a common intake manifold. There, an air mass sensor, such as an HFM-sensor, can be provided with which the air mass inducted via the intake manifold can be measured.

Separate exhaust-gas pipes are connected at the exhaust ends to the two cylinder banks. Each of these exhaust-gas pipes is assigned a sensor which is provided for measuring the composition of the exhaust gas. If the engine is a gasoline engine, then the two sensors are conventionally realized as lambda probes.

The HFM-sensor generates an output signal which is relevant to the same extent for both cylinder banks. If the output signal is defective (for example, because of a defect of the HFM-sensor), then this effects a fault, which is independent of the cylinder bank, in the control (open loop and/or closed loop) of the engine. Other faults, which are independent of the cylinder bank, can arise, for example, because of a defective fuel pressure or the like. Such cylinder-independent faults can lead to misfires or to the standstill of the engine.

The fuel masses, which are to be injected into the two cylinder banks, are each separately computed by a control apparatus in dependence upon the output signals of the lambda probes which are arranged in the exhaust-gas pipes of the two cylinder banks. In the above-mentioned gasoline engine, respective control factors are computed in dependence upon the output signals of the two lambda probes. The control factors influence the injection of fuel into the respective corresponding cylinder banks. This control factor is usually generated with the aid of a so-called lambda controller. A separate lambda controller is assigned to each of the two cylinder banks.

Furthermore, an adaptation is assigned to each of the two cylinder banks. In this way, the control factor does not have to be used in order to compensate, for example, for deteriorations of the engine. This is corrected with the aid of the adaptation.

If one of the two sensors in the exhaust-gas pipes of the engine exhibit a malfunction, this then defines a cylinder-bank dependent fault. In this case, the lambda controller, which corresponds to the defective sensor, attempts to compensate this malfunction by a corresponding change of the control factor. The lambda controller of the intact sensor of the other cylinder bank is, however, not affected by this compensating operation.

Cylinder bank dependent faults of this kind can also arise because of other defects which always separately affect only one of the two cylinder banks.

Such cylinder-bank dependent faults can lead to the situation that the cylinder bank, which is associated with the fault, is operated with an air/fuel mixture which is much too rich. This, in turn, can lead to misfires or even to damage of the catalytic converter assigned to the cylinder bank.

In total, a cylinder-bank independent fault as well as a cylinder-bank dependent fault cause a similar reaction of the engine, namely, the misfire of cylinders. Cylinder-bank dependent and cylinder-bank independent faults cannot be distinguished or are distinguishable much too late from this reaction.

SUMMARY OF THE INVENTION

It is an object of the invention to provide a method with which the cylinder-bank dependent and the cylinder-bank independent faults can be distinguished.

The method of the invention is for operating an internal combustion engine including an internal combustion engine for a motor vehicle. The engine has a plurality of cylinders arranged in two cylinder banks and the method includes the steps of: providing first and second sensors for corresponding ones of the cylinder banks to determine the composition of the exhaust gas and the first and second sensors outputting first and second output signals (uvsk1, uvsk2); determining first and second control factors (fr1, fr2) for corresponding ones of the cylinder banks in dependence upon the first and second output signals (uvsk1, uvsk2), respectively, and the first and second control factors (fr1, fr2) being applied for influencing the respective fuel masses (ti1, ti2) to be injected into corresponding ones of the cylinder banks; comparing the control factors (fr1, fr2) to each other; and, distinguishing between a cylinder-bank independent fault and a cylinder-bank dependent fault in dependence upon the first and second control factors (fr1, fr2).

If a cylinder-bank dependent fault is present, that is, for example, one of the two sensors in the exhaust-gas pipes of the engine exhibits a fault, then this has the consequence that the corresponding lambda controller attempts to correct this fault by correspondingly influencing the fuel mass to be injected. The control factor of this lambda controller changes especially in the direction of a rich operation of the corresponding cylinder bank. For a cylinder-bank dependent fault (that is, for example, under the precondition that only one of the two sensors in the exhaust-gas pipes of the engine exhibits a fault), this has the consequence that the control factor of that cylinder bank wherein the fault or the defect of the sensor is present deviates from that control factor which belongs to the other cylinder bank. This deviation of the two control factors from each other is detected.

According to the invention, this deviation is used to distinguish between a cylinder-bank independent fault and a cylinder-bank dependent fault. In this way, a malfunction of the engine is reliably detected.

A conclusion is drawn as to a cylinder-bank independent fault especially when the two control factors do not deviate significantly from each other.

It is especially advantageous when a conclusion is drawn as to a cylinder-bank dependent fault for a significant deviation of the two control factors.

In this way, it is possible to detect a cylinder-bank dependent fault reliably and early and especially the defect of one of the two sensors in the exhaust-gas pipes of the engine. For this reason, countermeasures can already be initiated before, for example, the adaptation intervenes. The adaptation, for example, corresponds to the defective sensor.

This early detection of a fault per se as well as the early distinguishability between a cylinder-dependent and a cylinder-bank independent fault is of special significance in direct-injecting engines. In these engines, the generated torque is directly dependent upon the injected fuel mass in the so-called stratified charge operation. For a cylinder-bank dependent fault, if the corresponding lambda controller or the corresponding adaptation would undertake an enrichment of the air/fuel mixture in order to compensate for the fault, then this would have as a consequence that a larger torque is generated. This larger torque would then lead to an acceleration of the motor vehicle which is not even wanted by the driver thereof.

It is therefore of great significance that an occurring fault is detected quickly and properly corrected. This is reliably achieved by the invention for direct-injecting internal combustion engines. It is possible to rapidly initiate the proper correction of the fault with the distinguishability between the cylinder-bank dependent and the cylinder-bank independent faults. Especially for a cylinder-bank dependent fault, only the affected cylinder bank need be influenced; whereas, for a cylinder-bank independent fault, both cylinder banks have to be correspondingly corrected.

In this way, it is, inter alia, ensured that an unwanted acceleration of the engine and therefore of the vehicle does not take place.

Basically, the described invention can be utilized in gasoline as well as diesel engines. Likewise, the invention can be applied to intake-manifold injections as well as for direct injections. A condition precedent is, however, that at least a dual exhaust-gas sensor arrangement is present.

As already explained, it is, however, especially advantageous to apply the invention to an internal combustion engine having gasoline direct injection wherein a lambda controller is provided with which the air/fuel ratio, which is to be supplied to the engine, is controlled (open loop and/or closed loop) to a stoichiometric value.

An advantageous further embodiment of the invention is applicable where an adaptation for the fuel mass, which is to be injected into both cylinder banks, is carried out. Here, for a fault detected as being cylinder-bank dependent, the adaptation values of the defective cylinder bank are set to the adaptation values of the other cylinder bank. In this way, it is achieved that both cylinder banks of the engine can continue to be operated as though no basic fault were present.

Another embodiment of the invention is applicable where a tank-venting system is connected to an intake manifold of the engine and wherein a tank-venting adaptation is carried out for the fuel mass supplied via the tank-venting system. In this embodiment, for a fault detected as cylinder-bank independent, the tank-venting adaptation changes into an emergency program or, for a fault detected as cylinder-bank dependent, the tank-venting adaptation is carried out in dependence upon the cylinder bank detected as being non-defective. The tank-venting adaptation is, for example, held constant in the context of the emergency program. In this way, a defective sensor does not cause a basic change of the tank-venting adaptation. In lieu thereof, the tank-venting adaptation is carried out in such a manner that the engine including the tank venting continues to be carried out without a basic fault occurring thereby.

Of special significance is the realization of the method of the invention in the form of a computer program which is provided for the control apparatus of the internal combustion engine. The computer program can be run on a computer of the control apparatus and is suitable for executing the method of the invention. In this case, the invention is therefore realized by the computer program so that this computer program defines the invention in the same manner as the method for which the computer program is suitable for carrying out. The computer program can preferably be stored on a flash memory. A microprocessor can be provided as a computer.

Other features, application possibilities and advantages of the invention will become apparent from the description of the embodiments of the invention which follows and which are shown in the drawing. Here, all described or illustrated features by themselves or in any combination define the subject matter of the invention independently of their composition in the patent claims or their dependency as well as independently of the formulation or presentation in the description or in the drawing.

BRIEF DESCRIPTION OF THE DRAWING

The invention will now be described with respect to the single FIGURE (FIG. 1) of the drawing which shows a block circuit diagram of an embodiment of the internal combustion engine of the invention. In this block circuit diagram, the engine as well as the method of the invention for operating the engine are shown.

DESCRIPTION OF THE PREFERRED EMBODIMENTS OF THE INVENTION

Figure 1:
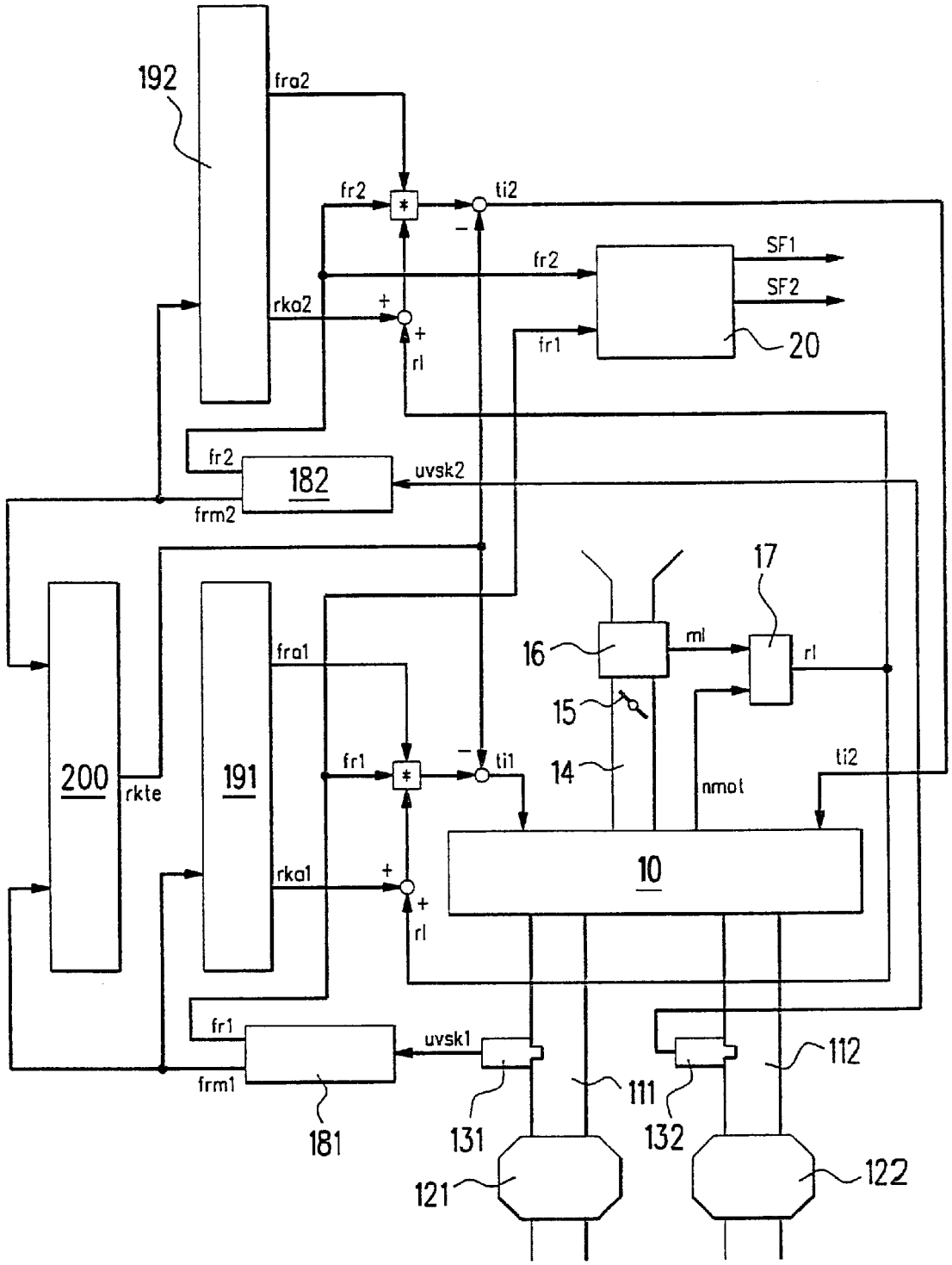

In FIG. 1, an internal combustion engine 10 is shown which is utilized especially in a motor vehicle. The engine 10 is preferably a gasoline engine. The internal combustion engine 10 can be provided with an intake manifold injection and/or with direct injection. The engine 10 includes two cylinder banks. The engine 10 can therefore preferably be a six, eight or other multi-cylinder engine.

Respective exhaust-gas pipes (111, 112) lead from corresponding ones of the two cylinder banks of the engine 10 to respective catalytic converters (121, 122). The catalytic converters (121, 122) can each be a three-way catalytic converter, a storage catalytic converter and/or the like.

Respective sensors (131, 132) are accommodated in corresponding ones of the exhaust-gas pipes (111, 112). The sensors (131, 132) are provided in order to measure the composition of the exhaust gas in the corresponding exhaust-gas pipe (111, 112). For a gasoline engine, the sensors (131, 132) can be preferably lambda probes.

Furthermore, the engine 10 is provided with an intake manifold 14 in which a throttle flap 15 as well as a sensor 16 are accommodated. The sensor 16 is preferably a hot-film measuring device with which the air mass, which flows to the engine 10, can be measured. The intake manifold 14, the throttle flap 15 and the sensor 16 function to supply the air, which is required for the combustion, to the two cylinder banks of the engine 10.

The sensor 16 generates an output signal which represents the air mass ml supplied to the engine 10. This air mass ml is converted by block 17 into a relative air mass rl in dependence upon the rpm nmot of the engine 10.

Output signals are generated by the two sensors 131 and 132, respectively, and these output signals are identified in FIG. 1 by uvsk1 and uvsk2, respectively. In the following, only the processing of the output signal uvsk1 is explained in detail. The processing of the output signal uvsk2 takes place in a corresponding manner and is therefore not explained in detail in order to avoid repetition.

The output signal uvsk1 of sensor 131 is supplied to a control (open loop and/or closed loop) 181 which generates a control factor fr1 as well as a mean value frml. If the composition of the exhaust gas in the exhaust-gas pipe 111 corresponds to a pregiven composition, then the control factor fr1=1. In a gasoline engine, the control factor fr1=1 when the engine 10 is driven with a stoichiometric air/fuel ratio.

The mean value frm1 is supplied to a block 191 which generates a multiplicative adaptation signal fra1 as well as an additive adaptation signal rka1 in dependence upon the mean value frm1. Changes of the engine 10 are compensated with these two adaptation signals fra1 and rka1. Deterioration or other slow changes of the engine 10 are corrected especially with the aid of the block 191. With the two adaptation signals fra1 and rka1, the control factor fr1 need not be applied in order to control out this kind of changes of the engine 10.

The relative air mass rl is generated by block 17 and is additively coupled to the adaptation signal rka1. The signal which arises herefrom defines a precontrol signal for the fuel mass to be injected into the engine 10.

This precontrol signal is multiplicatively coupled to the control factor fr1 as well as to the adaptation signal fra1. From this, the injection duration til results which defines the fuel mass to be injected into the engine 10.

In a corresponding manner, the injection duration ti2 is generated with the aid of blocks 182 and 192 from the output signal uvsk2 of the sensor 132 and the relative air mass rl. Here, the control factor fr2, inter alia, arises as already explained and is always equal to 1 when the composition of the exhaust gas in the exhaust-gas pipe 112 corresponds to a desired composition.

The two injection durations (ti1, ti2) relate to the two cylinder banks of the engine 10. The injection durations (ti1, ti2), which follow each other sequentially in time, are then assigned to the respective cylinders of the two cylinder banks based on the time-dependent allocations.

With respect to blocks (181, 182), it is noted that it can be any kind of a control (open loop and/or closed loop). With respect to blocks 191 and 192, it is noted that a plurality of possibilities is present for the generation of the respective adaptation signals. Thus, it is possible that the various load ranges and/or rpm ranges of the engine 10 are distinguished and that different adaptation signals are generated in these different ranges, respectively. The adaptation signals can be preferably summed signals or integrated signals which can still change in dependence upon rpm as required and/or can be interpolated in another way.

A short circuit (for example, a short circuit of sensor 131 to ground) or some other fault of this sensor 131 can have the result that the composition of the exhaust gas in the exhaust-gas pipe 111 is not correctly detected. This can cause the situation that the block 181 shifts the injection duration ti1 via the control factor fr1 in such a manner that more fuel is injected into the cylinder bank of the engine 10 corresponding to the sensor 131. Especially for a short circuit of sensor 131 to ground, a relatively intense amplitude of the control factor fr1 can occur.

The control factor fr1 of the one cylinder bank as well as the control factor fr2 of the other cylinder bank of the engine 10 are compared to each other in block 20. If it is determined in block 20 that the control factor fr1 deviates significantly from the control factor fr2, then a conclusion is drawn therefrom as to a cylinder-bank dependent fault. This cylinder-bank dependent fault is a fault of one of the two sensors (131, 132) in the described embodiment. However, other cylinder-bank dependent faults are conceivable which are then correspondingly detected by the block 20. The block 20 thereupon generates separate output signals SF1 and SF2 for each cylinder bank.

This detection of a fault for one of the two sensors (131, 132) is based on the fact that the corresponding control factor fr1 and/or fr2 changes significantly, for example, for a short circuit of one of the two sensors (131, 132) to ground. The control factor belonging to the other, intact sensor does, however, not change. From this results a significant deviation of the two control factors from each other. This deviation is finally detected by block 20. From this deviation of the control factor fr1 from the control factor fr2, block 20 draws the conclusion as to a fault of one of the two sensors (131, 132). The block 20 distinguishes which of the two sensors (131, 132) is defective and outputs a corresponding output signal SF1 or SF2.

If a defective operating state of the engine 10 is detected by the block 20, then this can be indicated to the driver of the motor vehicle by appropriate means. Likewise, it is possible (for example, with the aid of a memory) to store a corresponding indication which can be detected with the next repair or service of the motor vehicle and can be processed. One can distinguish which one of the cylinder banks is defective with the indication and storage of a defective operating state. As a further possibility, the generation of the injection duration ti1 or ti2 can be influenced after the detection of a fault of this kind of the engine 10.

This can, for example, take place in that the adaptation signals of that cylinder bank, for which the control factor has departed essentially into the rich region, can be set to those values of the adaptation factor of the other cylinder bank and maintained. In this way, the situation is prevented that, because of the permanent defect of the corresponding sensor 131 or 132, not only the control factor remains at a permanent rich value but, after a certain time, also the adaptation signals remain in the rich region. With this fixing of the adaptation signal of that cylinder bank wherein a defective sensor is suspected, the situation is achieved that the engine 10 can continue to be operated with the values of the adaptation signals of the other cylinder bank without a basic malfunction arising therefrom.

If, in contrast, a fault occurs in the engine which is independent of a specific cylinder bank (for example, if a fault occurs in sensor 16 or in the fuel pressure control), this causes no significant deviation of the control factor fr1 from the control factor fr2. In lieu thereof, a cylinder-bank independent fault of this kind causes a change of the two control factors fr1 and fr2 in approximately the same manner. For this reason, it is not possible to detect in block 20 a cylinder-bank independent fault of this kind based on the non-existent significant deviation of the two control factors (fr1, fr2) from each other.

There are, however, additional fault detection means present preferably in block 20 with which, in general, a malfunction of the engine can be detected. These fault detecting means are, however, usually riot suited for distinguishing whether the fault is a cylinder-bank dependent fault or a cylinder-bank independent fault. This distinguishability can, however, be undertaken with the aid of the above-described functionality (block 20). If the general fault detecting means indicate a malfunction of the engine and the two control factors (fr1, fr2) do not deviate significantly from each other, then the fault is a cylinder-bank independent fault. If the two control factors (fr1, fr2), however, deviate significantly from each other, then the fault is a cylinder-bank dependent fault.

Supplementary to the above description of FIG. 1, the engine 10 is provided with a tank-venting system. This means that an additional air/fuel mixture is supplied to the cylinders of the engine 10 via the intake manifold 14. This additional air/fuel mixture must be considered in the determination of the injection durations (ti1, ti2) for the two cylinder banks of the engine 10. This takes place in that a tank-venting corrective signal rkte is generated which ultimately indicates that fuel mass which is supplied via the tank-venting system to the engine 10. This tank-venting corrective signal rkte applies for both cylinder banks and is therefore logically coupled to both injection durations (ti1, ti2) for the two cylinder banks of the engine 10.

A tank-venting adaptation 200 is provided for the generation of the tank-venting corrective signal rkte. This tank-venting adaptation 200 is, inter alia, dependent upon the control factors fr1 and fr2 of the two cylinder banks in a similar manner as for the blocks (191, 192). However, since only one common tank-venting adaptation 200 is present, for example, the mean value is formed from the two control factors (fr1, fr2) in order to derive an adaptation signal therefrom.

A fault of one of the two sensors (131, 132) has therefore also an influence on the tank-venting adaptation 200. Because of the mean-value formation, a fault of this kind effects not only the enrichment of the mixture composition in one of the two cylinder banks, but simultaneously effects a leaning in the other one of the two cylinder banks. However, ultimately a significant deviation, in turn, arises between the control factor fr1 for one of the two cylinder banks and the control factor fr2 of the other one of the two cylinder banks. This deviation of the two control factors (fr1, fr2) is, as already mentioned, detected by block 20 and a conclusion is drawn by the block 20 as to a defect of one of the two sensors (131, 132). The tank-venting adaptation can thereupon be operated in a constant manner, as may be required. Alternatively, it is possible to continue the tank-venting adaptation 200 in dependence upon the cylinder bank detected as non-defective.

The method steps described above as well as shown in FIG. 1 (especially block 20) are carried out by a control apparatus which is provided for the control (open loop and/or closed loop) of the engine 10. The control apparatus is provided with a computer, especially with a microprocessor, to which a so-called flash memory or the like is assigned for data storage. The described method is stored in the form of a computer program on the flash memory. If this computer program is carried out by the computer then this has the consequence that the method described with respect to FIG. 1 is carried out and the engine 10 is operated in the manner described.

It is understood that the foregoing description is that of the preferred embodiments of the invention and that various changes and modifications may be made thereto without departing from the spirit and scope of the invention as defined in the appended claims.

What is claimed is:

1. A method of operating an internal combustion engine including an internal combustion engine for a motor vehicle, the engine having a plurality of cylinders arranged in two cylinder banks, the method comprising the steps of:

providing first and second sensors for corresponding ones of said cylinder banks to determine the composition of the exhaust gas and said first and second sensors outputting first and second output signals (uvsk1, uvsk2);

determining first and second control factors (fr1, fr2) for corresponding ones of said cylinder banks in dependence upon said first and second output signals (uvsk1, uvsk2), respectively, and said first and second control factors (fr1, fr2) being applied for influencing the respective fuel masses (ti1, ti2) to be injected into corresponding ones of said cylinder banks;

comparing said control factors (fr1, fr2) to each other; and, distinguishing between a cylinder-bank independent fault and a cylinder-bank dependent fault in dependence upon said first and second control factors (fr1, fr2).

2. The method of claim 1, comprising the further step of drawing a conclusion as to a cylinder-bank independent fault when said first and second control factors (fr1, fr2) are significantly different from each other.

3. The method of claim 1, comprising the further step of drawing a conclusion as to a cylinder-bank dependent fault (SF1, SF2) when there is a significant deviation of said first and second control factors (fr1, fr2).

4. The method of claim 1, wherein said first and second sensors are first and second lambda probes; and, wherein said method further comprises determining each of said first and second control factors (fr1, fr2) from a control (open loop and/or closed loop) for generating a stoichiometric air/fuel ratio to be supplied to said engine.

5. The method of claim 1, comprising the further steps of:

carrying out respective adaptations for said fuel masses (ti1, ti2); and, setting the adaptation values of the defective one of said cylinder banks to the adaptation values of the other one of said cylinder banks when there is a cylinder-bank dependent fault (SF1, SF2).

6. The method of claim 1, wherein a tank-venting system is connected to an intake manifold of said engine; and, wherein the method comprises the further steps of:

carrying out a tank-venting adaptation for the fuel mass supplied via said tank-venting system; and, in the event of a fault detected as being cylinder-bank independent, then converting the tank-venting adaptation into an emergency program; or, in the event of a fault (SF1, SF2) detected as being cylinder-bank dependent, carrying out said tank-venting adaptation in dependence upon the cylinder bank detected as being non-defective.

7. The method of claim 1, comprising the further step of detecting that one of said first and second sensors as being defective whose corresponding control factor (fr1, fr2) moves essentially in the rich region.

8. A computer program for carrying out a method of operating an internal combustion engine including an internal combustion engine for a motor vehicle, the engine having a plurality of cylinders arranged in two cylinder banks and including first and second sensors for corresponding ones of said cylinder banks, the computer program comprising being suitable for carrying out the following steps when executed on a computer:

determining the composition of the exhaust gas and said first and second sensors outputting first and second output signals (uvsk1, uvsk2);

determining first and second control factors (fr1, fr2) for corresponding ones of said cylinder banks in dependence upon said first and second output signals (uvsk1, uvsk2), respectively, and said first and second control factors (fr1, fr2) being applied for influencing the respective fuel masses (ti1, ti2) to be injected into corresponding ones of said cylinder banks;

comparing said control factors (fr1, fr2) to each other; and, distinguishing between a cylinder-bank independent fault and a cylinder-bank dependent fault in dependence upon said first and second control factors (fr1, fr2).

9. The computer program of claim 8, wherein said program is stored on a memory.

10. The computer program of claim 9, wherein said memory is a flash memory.

11. A control apparatus for an internal combustion engine including an internal combustion engine for a motor vehicle, the engine having a plurality of cylinders arranged in two cylinder banks, the apparatus comprising:

first and second sensors for corresponding ones of said cylinder banks to determine the composition of the exhaust gas and said first and second sensors outputting first and second output signals (uvsk1, uvsk2);

means for determining first and second control factors (fr1, fr2) for corresponding ones of said cylinder banks in dependence upon said first and second output signals (uvsk1, uvsk2), respectively;

means for applying said first and second control factors (fr1, fr2) for influencing the respective fuel masses (ti1, ti2) to be injected into corresponding ones of said cylinder banks;

means for comparing said control factors (fr1, fr2) to each other; and, means for distinguishing between a cylinder-bank independent fault and a cylinder-bank dependent fault in dependence upon said first and second control factors (fr1, fr2).

12. An internal combustion engine including an internal combustion engine for a motor vehicle, the engine comprising:

a plurality of cylinders arranged in two cylinder banks;

first and second sensors for corresponding ones of said cylinder banks to determine the composition of the exhaust gas and said first and second sensors outputting first and second output signals (uvsk1, uvsk2); and, a control apparatus including means for determining first and second control factors (fr1, fr2) for corresponding ones of said cylinder banks in dependence upon said first and second output signals (uvsk1, uvsk2), respectively, and said first and second control factors (fr1, fr2) being applied for influencing the respective fuel masses (ti1, ti2) to be injected into corresponding ones of said cylinder banks; means for comparing said control factors (fr1, fr2) to each other; and, means for distinguishing between a cylinder-bank independent fault and a cylinder-bank dependent fault in dependence upon said first and second control factors (fr1, fr2).

* * * * *